US005473130A

United States Patent [19]

Pudims

[11] Patent Number: 5,473,130

[45] Date of Patent: Dec. 5, 1995

[54] THREE-POSITION RECEPTACLE SWITCH ASSEMBLY

[75] Inventor: Albert A. Pudims, Stratford, Conn.

[73] Assignee: Hubbell Incorporated, Orange, Conn.

[21] Appl. No.: 885,666

[22] Filed: May 19, 1992

[51] Int. Cl.[6] ..... H01H 21/80

[52] U.S. Cl. ..... 200/559

[58] Field of Search ..... 200/559, 519, 200/558

[56] References Cited

U.S. PATENT DOCUMENTS

| | | | |
|---|---|---|---|
| 1,215,807 | 2/1917 | Huff | 200/519 |
| 1,547,824 | 7/1925 | Roehm | 200/559 |
| 2,972,663 | 2/1961 | Zanichkowsky et al. | 200/558 X |
| 3,030,479 | 4/1962 | Ehrlich et al. | 200/559 X |
| 3,194,929 | 7/1965 | Carissimi et al. . | |
| 3,309,544 | 3/1967 | Lawson | 307/146 |
| 4,133,993 | 1/1979 | Judd . | |
| 4,656,321 | 4/1987 | Ruyten | 200/50 |

FOREIGN PATENT DOCUMENTS

| | | | |
|---|---|---|---|
| 593175 | 5/1959 | Italy | 200/519 |

*Primary Examiner*—Renee S. Luebke

*Attorney, Agent, or Firm*—Jerry M. Presson; David L. Tarnoff

[57] ABSTRACT

A receptacle switch having a center-off position, momentary-on position, and maintained-on position. The switch includes a housing with a toggle, a first stationary contact, a second stationary contact and a third movably contact, and a leaf spring therein. The toggle has a cam member which engages a cantilever arm supporting third contact to hold the third contact spaced between the first and second contacts in center-off position. The cam member also controls movements of the third contact from its center-off position, to maintained-on position, and to its momentary-on position. The leaf spring selectively engages a first notch in a bottom portion of the toggle to maintain the toggle in the off position, or engages a second notch in the bottom portion of the toggle to maintain the toggle in the maintained-on position, or engages a smooth portion of the bottom portion of the toggle to momentarily maintain the toggle in its momentary-on position until the toggle is released.

16 Claims, 4 Drawing Sheets

THREE-POSITION RECEPTACLE SWITCH ASSEMBLY

FIELD OF THE INVENTION

This invention relates to a receptacle switch assembly having an off position, a maintained-on position, and a momentary-on position. More specifically, the invention relates to a receptacle switch assembly having a housing, two spaced apart contacts fixedly coupled to the housing, a third contact movably coupled to the housing, and a toggle pivotally coupled to the housing. The toggle engages the third contact for maintaining it in its off position spaced between the first and second contacts, and for selectively moving it from the off position to a maintained-on position with the third contact electrically connected with the first contact and to a momentary-on position with the third contact electrically connected with the second contact. A leaf spring is coupled to the housing for selectively maintaining the toggle in its off position, or its maintained-on position, or for momentarily maintaining the toggle in its momentary-on position.

BACKGROUND OF THE INVENTION

The present invention relates to a three-position receptacle switch with a toggle having a center-off position, a maintained-on position, and a momentary-on position. Three-position switches are known in the prior art. However, some of these prior art switches combine two momentary-on positions with a center-off position. Thus, the advantageous maintained-on position cannot be achieved. Other prior art switches have a center-off and two maintained-on positions, and thus, lack the advantageous momentary-on position. Still other prior art three-position switches, which have a center-off position, momentary-on position, and a maintained-on position, are very complicated.

Examples of some prior three-position receptacle switches are disclosed in the following U.S. Pat. Nos.: 3,194,929 to Carissimi et al; 3,309,544 to Lawson; 4,133,993 to Judd; and 4,656,321 to Ruyten.

Thus, there exists a need to provide an improved receptacle switch with a center-off, momentary-on and maintained-on position which can be used for residential or commercial purposes, and is easy to install. This invention addresses this need in the art, along with other needs which will become apparent to those skilled in the art once given this disclosure.

SUMMARY OF THE INVENTION

Accordingly, a primary object of the invention is to provide a receptacle switch assembly having a center-off position, momentary-on, and maintained-on position which uses two stationary contacts and one movable contact in operation.

Another object of the invention is to provide a three-position receptacle switch assembly having a center-off position, momentary-on, and maintained-on position which has a relatively small number of parts, but which is very effective in performing its function.

Another object of the invention is to provide a receptacle switch assembly having a center-off position, maintained-on position, and momentary-on position which is relatively inexpensive to manufacture.

A further object of the invention is to provide a receptacle switch assembly having a center-off position, momentary-on position, and maintained-on position that can be used for either residential, industrial or commercial purposes.

The foregoing objects are basically attained by providing a receptacle switch assembly having a center-off, momentary-on, and maintained-on position, comprising: a housing; first and second contacts coupled to the housing and spaced apart; a third contact movably coupled to the housing; a toggle coupled to the housing for selectively moving the third contact from an off position spaced from the first and second contacts, a maintained-on position electrically connected with the first contact, and position electrically coupled with the second contact; and a leaf spring coupled to the housing for selectively maintaining the toggle in the center-off position and the maintained-on position, and momentarily maintains the toggle in the momentary-on position.

Other objects, advantages, and salient features of the invention will become apparent from the following detailed description, which, taken in conjunction with the annexed drawings, discloses the invention.

BRIEF DESCRIPTION OF THE DRAWINGS

Referring now to the drawings which form a part of this original disclosure.

DETAILED DESCRIPTION OF THE INVENTION

Figure 1:
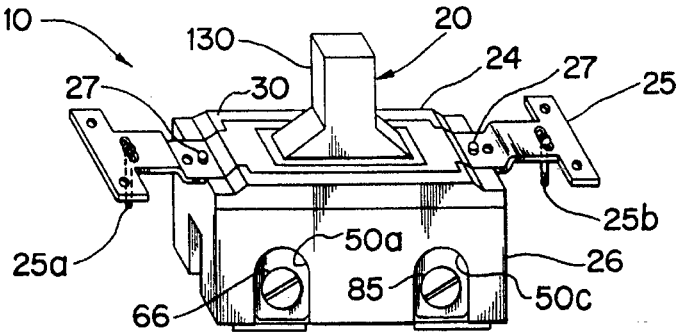
FIG. 1 is a perspective view of the exterior of a receptacle switch assembly in accordance with the present invention with its toggle in a center-off position.

As seen in FIGS. 1–4, a receptacle switch 10 in accordance with the present invention is illustrated, and includes an insulating housing 12, first and second stationary contacts 14 and 16 coupled to housing 12, a third contact 18 movably coupled to housing 12, a toggle 20 pivotally coupled to housing 12 for selectively moving third contact 18 from a center-off position into electrical contact with either first contact 14 or second contact 16, and a leaf spring 22 coupled to housing 12 for selectively maintaining toggle 20 in a center-off position, a maintained-on position, and for momentarily maintaining toggle 12 in the momentary-on position.

As seen in FIGS. 1–6, housing 12 includes a lid or top portion 24, a mounting strap 25, and a body or bottom portion 26. Preferably, lid 24 and body 26 are each formed or molded from a hard, rigid plastic material such as a thermoplastic, or any other suitable insulating material.

Mounting straps, such as mounting strap 25, are conventional and well known, and thus, mounting strap 25 will not be discussed in detail. Mounting strap 25 is made of a metallic material and provided with a pair of mounting screws 25*a* and 25*b* at the respective ends of mounting strap 25 for mounting receptacle switch 10 to an electrical box.

Lid 24, mounting strap 25 and body 26 are all typically coupled together by a pair of screws 27 extending through holes 33 in lid 24, and holes 40 of body 26, and then threadedly received in threaded holes 29 in strap 25. Alternatively, screws 27 can be replaced with a pair of rivets for riveting lid 24, strap 25 and body 26 together.

Figure 11:
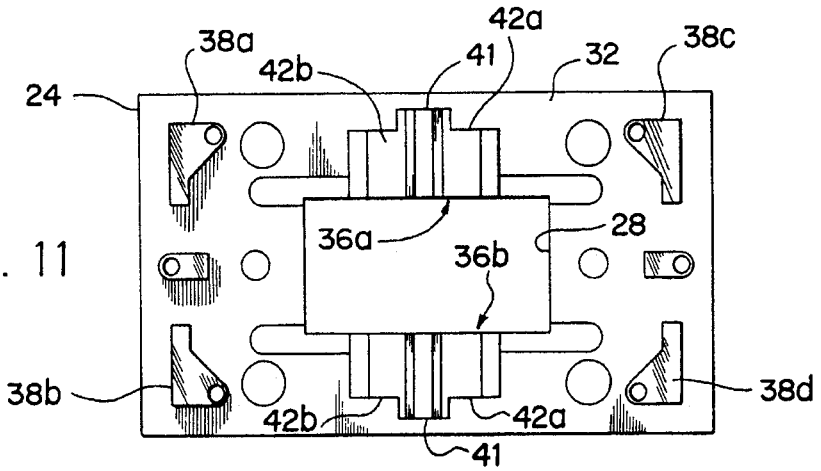
FIG. 11 is a bottom plan view of the lid of the receptacle switch assembly of FIGS. 1–4.
Figure 12:
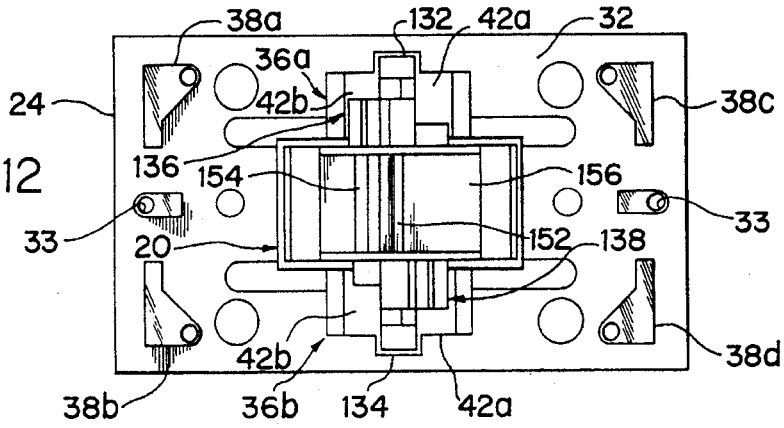
FIG. 12 is a bottom plan view of the lid of the receptacle switch assembly of FIG. 11 with the toggle positioned therein.

As seen in FIGS. 11 and 12, lid 24 is substantially rectangular, and includes a center rectangular opening 28, a top or exterior side 30, bottom or interior side 32 and a pair of clearance or tapped holes 33 for receiving screws 27 or rivets therein.

Center rectangular opening 28 extends completely through lid 24 from top side 30 to bottom side 32 for receiving a portion of toggle 20 therethrough. Top side 30 has a recess 35 for receiving a portion of mounting strap 25 therein so that the exposed surface of mounting strap 25 is substantially flush with the exterior surface of top side 30. In other words, the depth of recess 35 is substantially equal to the thickness of mounting strap 25.

Bottom side 32 of lid 24 includes a centrally located cutout 34 and four positioning legs 38. Positioning legs 38 are integrally and unitarily coupled to bottom side 32, and extend substantially perpendicularly from bottom side 32. Each of the legs 38 is substantially L-shaped and positioned adjacent one of the corners of bottom side 32. When lid 24 is coupled to body 26, the legs 38 extend downwardly into body 26 for maintaining proper alignment between lid 24 and body 26, and for holding contacts 14, 16 and 18 in their relative positions to one another as discussed below.

Cutout 34 extends across opening 28, and has a first half 36*a* and a second half 36*b* for pivotally receiving a portion of toggle 20 as discussed below. Halves 36*a* and 36*b* are substantially identical, except that they are mirror images of each other. Thus, the same reference numerals will be used for both halves 36*a* and 36*b*. Each of the halves 36*a* and 36*b* includes a central recess 41 for pivotally receiving a portion of toggle 20, and a pair of stop surfaces 42*a* and 42*b* positioned on opposite sides of recess 41 for limiting pivotal movement of toggle 20. Cutout 34 has the same depth throughout, except at central recesses 41, where the depth increases.

Figure 13:
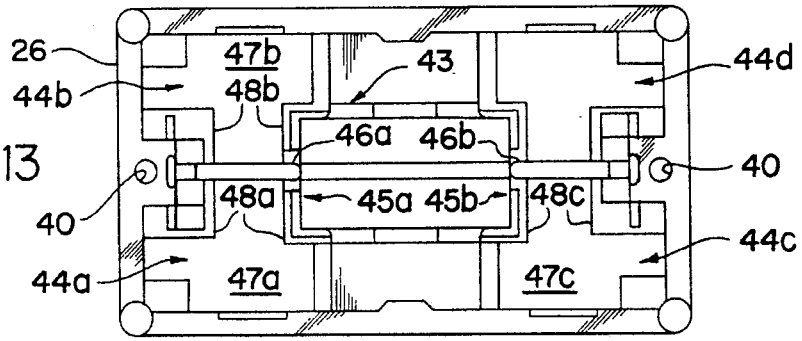
FIG. 13 is a top plan view of the body of the housing of the receptacle switch assembly of FIGS. 1–4.
Figure 14:
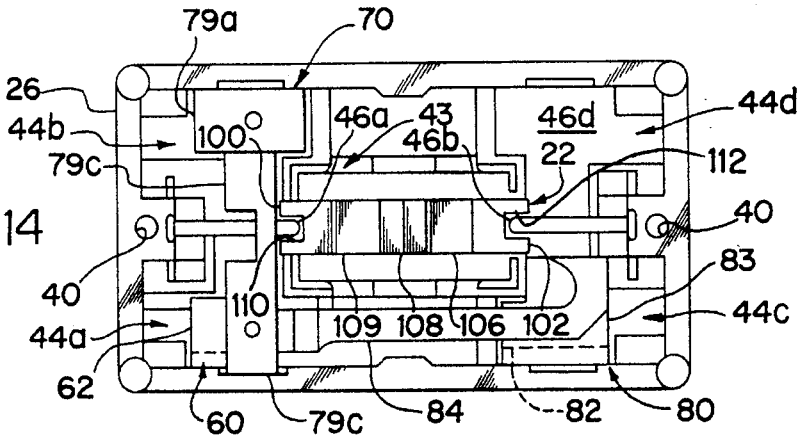
FIG. 14 is a top plan view of the body of the housing of the receptacle switch of FIG. 13 with the three terminal harnesses inserted therein.

As seen in FIGS. 12 and 13, body 26 includes a pair of screw or clearance holes 40 for receiving screws 27 or rivets, a center shelf 43 for receiving leaf spring 22, a first compartment 44*a*, a second compartment 44*b*, a third compartment 44*c* and a fourth compartment 44*d*. Compartments 44*a*–44*d* are all substantially identical, except that compartments 44*c* and 44*d* are mirror images of compartment 44*a* and 44*b*, and compartment 44*d* does not have a window as discussed below. Thus, only compartment 44*a* will be discussed in detail herein.

First compartment 44*a* has a T-shaped recess 47*a*, a lip or ledge 48*a* surrounding and first window 50*a*. Second compartment 44*b* has a T-shaped recess 47*b*, a lip or ledge 48*b* and a second window 50*b*. Similarly, third compartment 44*c* has a T-shaped recess 47*c*, a third lip or ledge 48*c* and a third window 50*c*.

Shelf 43 has a first end 45*a*, a second end 45*b* and a pair of abutments 46*a* and 46*b* located at ends 45*a* and 45*b*, respectively. Shelf 43 supports leaf spring 22 on ends 45*a* and 45*b*. Abutments 46*a* and 46*b* restrict movement of leaf spring 22.

Lid 24 and strap 25 are secured to body 26 by placing lid 24 and strap 25 on top of body 26 so that lid screw holes 33, strap holes 29 and body screw holes 40 all evenly align and then inserting screws 27 therethrough to securely fasten lid 24 and mounting strap 25 to body 26, thereby forming housing 12. Of course, screws 27 can be replaced with a pair of rivets.

Contacts 14, 16 and 18 are preferably made of silver cadmium and are fixedly coupled to terminal harnesses 60, 70, and 80, respectively. Terminal harnesses 60, 70 and 80 are coupled to wire conductors (not shown) for supply power through and from switch 10. Thus, when third movable contact 18 is contacting either first contact 14 or second contact 16 an electrical path will be completed so that electricity passes through switch 10.

Figure 7:
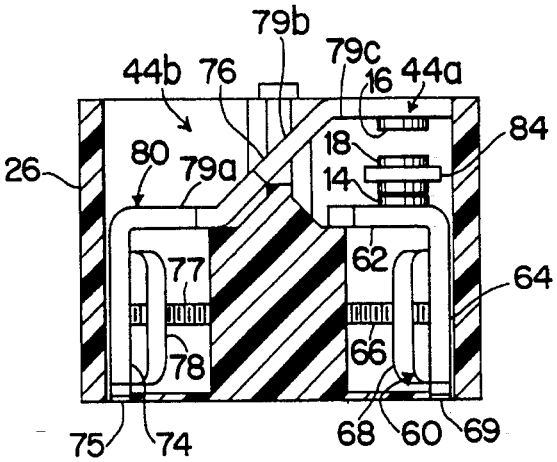
FIG. 7 is a left end elevational view of the receptacle switch assembly of FIGS. 1–6 with a portion of the body of the housing broken-away to illustrate the relative positions of the contacts while in the maintained-on position in accordance with the present invention.
Figure 8:
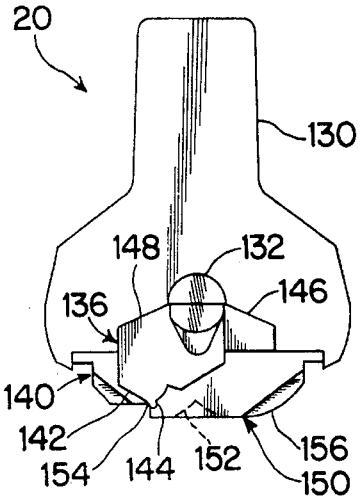
FIG. 8 is a side elevational view of the toggle of the receptacle switch assembly shown in FIGS. 1–5.
Figure 9:
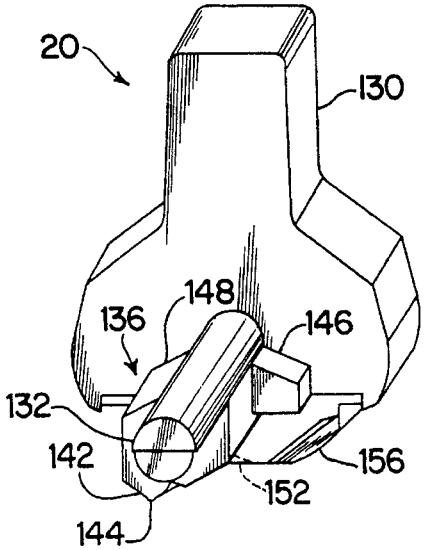
FIG. 9 is a right, front perspective view of the toggle of the receptacle switch assembly of FIG. 8.
Figure 10:
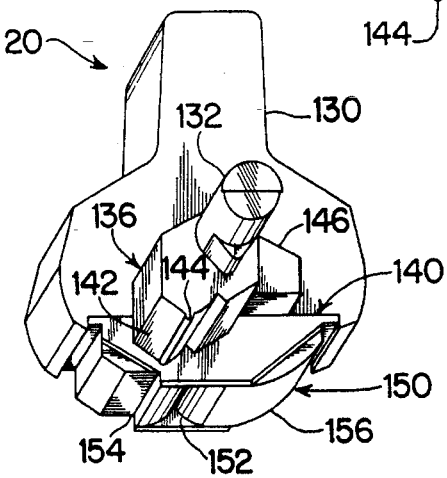
FIG. 10 is a left, front perspective view of the toggle shown in FIGS. 8 and 9.

As seen in FIG. 7, first contact 14 is fixedly coupled to a first terminal harness 60. First terminal harness 60 is substantially L-shaped and rests upon ledge 48*a* and in window 50*a* of first compartment 44*a*. Terminal harness 60 includes a top leg 62 with first contact 14 fixedly coupled thereto, and a bottom leg 64 rigidly coupled to leg 62. A terminal screw 66 and a nut 68 are adapted to be coupled to terminal harness 60.

Top and bottom legs 62 and 64 are integrally formed as a unitary, one-piece metallic member. Preferably, legs 62 and 64 are constructed of a copper alloy or any other suitable conductive material. Top leg 62 is substantially parallel with lid 24 when switch 10 is assembled, and has first contact 14 fixedly coupled thereto.

Bottom leg 64 is substantially rectangular with its lower corners removed, and extends substantially perpendicularly and downwardly from top leg 62. Bottom leg 64 has a bottom edge 69 overhanging first ledge 48*a*, thereby coupling first contact 14 to housing 12.

Terminal screw 66 extends through a hole in the center of bottom leg 64 and secured to bottom leg 64 by nut 68. Terminal screw 66 sits within first window 60. First terminal harness 60 is held, in position within first compartment 44*a* by leg 38*a* of lid 24. In particular, leg 38*a* engages and holds top leg 62 against ledge 48*a* to prevent movement of first terminal harness 60.

Second contact 16 is fixedly coupled to a second terminal harness 70. Second terminal harness 70 rests in second compartment 44*b*, and includes a support leg 74 having a bottom edge 75, an extending arm 76. A second terminal screw 77 and a second nut 78 are adapted to be coupled to terminal harness 70.

Support leg 74 extends vertically upwardly from bottom edge 75 and is integrally and unitarily coupled to extending arm 76.

Second bottom edge 75 of support leg 74 overhangs second ledge 48*b*, thereby coupling second contact 16 to housing 12.

Extending arm 76 has a first portion 79*a*, second portion 79*b* and third portion 79*c*. First portion 79*a* extends perpendicularly and inwardly from support leg 74. Second portion 79*b* is unitarily and integrally connected to first portion 79*a*, and inclines inwardly and upwardly away from first portion 79*a*. Third portion 79*c* is integrally and unitarily coupled to second portion 79*b*, and extends inwardly therefrom. Third portion 79*c* is substantially parallel with first portion 79*a*. Second contact 16 is fixedly coupled to third portion 79*c*.

Second terminal screw 77 extends through a centrally located opening in support leg 74, substantially parallel to lid 24, sits within second window 62, and is secured to support leg 74 by nut 78. Second terminal harness 70 is held in position within second compartment 44*b* by leg 38*b* of lid 24. In particular, leg 38*b* engages and holds top leg 62 against ledge 48*b* to prevent movement of second terminal harness 70.

Third contact 18 is a double contact spaced between first and second contacts 14 and 16, and is fixedly coupled to a third terminal harness 80. Third terminal harness 80 rests in third compartment 44*c*, and includes a support member 82, a connecting member 83, and a cantilever arm 84. A third terminal screw 85, and a nut (not shown) are adapted to be coupled to third terminal harness 80.

Support member 82 has a third bottom edge 86 overhanging third lip 48*c* of third window 44*c*, thereby coupling third contact 18 to housing 12. Support member 82 extends upwardly from third bottom edge 86 being substantially perpendicular to lid 24.

Connecting member 83 is integrally and unitarily coupled between support member 82, and cantilever arm 84, and extends substantially perpendicularly and inwardly from support member 82.

Cantilever arm 84 extends outwardly from connecting member 83 toward first and second contacts 14 and 16, being substantially parallel with lid 24. The end of cantilever arm 84 is integrally coupled to third contact 18.

Third terminal screw 85 extends through a centrally located opening in support member 82, and extends substantially parallel to lid 24. Third terminal screw 85 sits within third window 44*c* and is secured to support member 82 by a nut (not shown). Third terminal harness 80 is held in position within second compartment 44*c* by leg 38*c* of lid 24. In particular, leg 38*c* engages and holds connecting member 83 against ledge 48*c* to prevent movement of third terminal harness 80.

Leaf spring 22 includes a first end portion 100, a second end portion 102, a first intermediate portion 104 extending upwardly and away from first end portion 100 towards second end portion 102, a second intermediate portion 106 extending upwardly and away from second end portion 102 towards first end portion 100, and a central nose portion 108 located between intermediate portions 104 and 106.

Leaf spring 22 is initially pre-loaded upon assembling switch 10. In particular, leaf spring 22 sits on shelf 43 with first and second end portions 100 and 102 constrained from longitudinal movement by abutments 46*a* and 46*b*, and is compressed downwardly towards shelf 43 by toggle 20. Accordingly, toggle 20 is held upwardly against lid 24 by the force of pre-loaded leaf spring 22.

First end portions 100 and 102 are substantially identical, and have a U-shaped cutout portions 110 and 112, respectively, located at the free longitudinal ends of leaf spring 22.

Preferably, leaf spring 22 has a first layer 120 and second layer 122. First and second layers 120 and 122 are preferably made of beryllium copper, or any other suitable resilient material. Layers 120 and 122 are substantially identical to each other so that first layer 120 nests immediately on top of second layer 122. While leaf spring 22 is preferably constructed of two layers, it is possible to construct leaf spring 22 of one layer or more than two layers of resilient material.

Nose portion 108 engages first notch 152 when toggle 20 is in its center-off position, thereby maintaining toggle 20 in that position. Nose portion 108 engages second notch 154 when toggle 20 is in its maintained-on position to maintain toggle 20 in that position. Nose portion 108 engages smooth portion 156 when toggle 20 is in the momentary-on position to momentarily maintain toggle 20 in that position until toggle 20 is released. Then, upon releasing toggle 20, toggle 20 immediately rotates back to the center-off position from the momentary-on position.

As seen in FIGS. 8–10 and 12, toggle 20 includes trigger or lever 130, a first trunnion 132, a second trunnion 134, a first cam member 136, a second cam member 138, and a bottom portion 140. Preferably, trigger lever 130, trunnions 132 and 134, and cam members 136 and 138 are all integrally formed or molded as a one-piece unitary member from a suitable, rigid plastic material such as nylon or any other suitable thermoplastic material.

Bottom portion 140 is preferably coupled to the bottom of trigger 130 by an adhesive or interference fit, and is formed or molded from a suitable, rigid plastic material such as nylon or any other suitable thermoplastic material. Alternatively, bottom portion 140 can be integrally formed with trigger 130, trunnions 132 and 134 and cam members 136 and 138 as a one-piece, unitary member.

A portion of trigger 130 extends through center opening 28 for a person to grip, and then pivot toggle 20 about a transverse pivot axis extending through the center of trunnions 132 and 134. When lid 24 is secured to body 26, toggle 20 is rotatably, pivotally, and securely coupled within housing 12.

First and second trunnions 132 and 134 extend substantially perpendicularly from opposite sides of toggle 20. The free ends of trunnions 132 and 134 are substantially cylindrical. Trunnions 132 and 134 serve as pivot pins which are received in recesses 41 of lid 24 for pivoting toggle 20 relative to housing 12.

First and second cam members 136 and 138 are substantially identical, and thus only cam member 136 will be discussed in detail. First cam member 136 engages cantilever arm 84 for selectively moving third contact 18 into electrical contact with first contact 14 and to a position spaced between first and second contacts 14 and 16.

Figure 2:
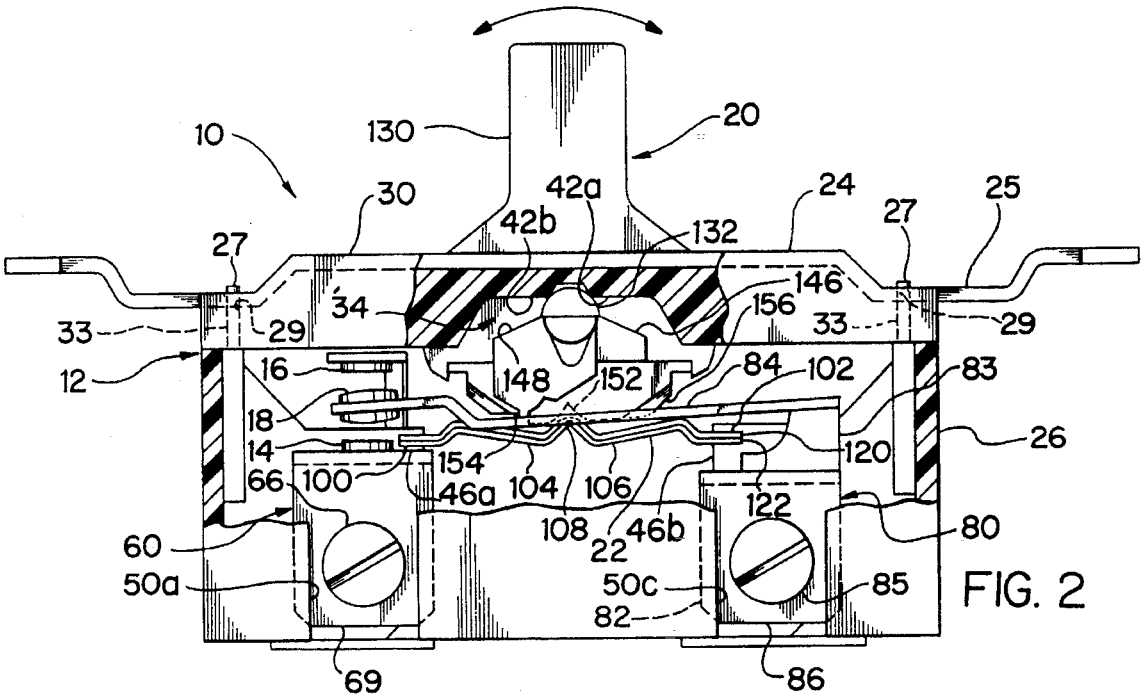
FIG. 2 is a side elevational view of the receptacle switch assembly of FIG. 1 with its toggle in a center-off position, and with a portion broken away to illustrate the positions of its contacts and spring in relation to the toggle in accordance with the present invention.

Cam member 136 has a V-shaped camming surface 142 with a rib 144. As seen in FIG. 2, camming surface 142 is off set to the left of trunnion 132 and engages cantilever arm 84 for holding or maintaining cantilever arm 84 in a first position so that third contact 18 remains spaced between first and second contacts 14 and 16.

Upon rotation of toggle 20 to the left (maintained-on position) from the center-off position, camming surface 142 with rib 144 slides to the right along cantilever arm 84. As camming surface 142 moves to the right, camming surface 142 also moves downwardly against the upward force of cantilever arm 84. This downwardly movement of camming surface 142 also moves cantilever arm 84 downwardly until third contact 18 electrically contacts first contact 14.

Upon rotation of toggle 20 to the right (monetary-on position) from the center-off position, camming surface 142 with rib 144 slides to the left and upwardly along cantilever arm 84, and then upwardly out of engagement with cantilever arm 84. In particular, as cam member 136 moves upwardly, the pressure on cantilever arm 84 is released so that cantilever arm 84 moves upwardly into until third contact 18 electrically contacts second contact 16. Cantilever arm 84 should still be held at least partially pre-loaded by second contact 16 to maintain good electrical contact between second and third contacts 16 and 18.

Also, first cam member 136 has a pair of stop surfaces 146 and 148 for limiting the pivotal movement of toggle 20 in both directions from the center-off position. Stop surfaces 146 and 148 are located on opposite sides of first trunnion 132, and slope downwardly and outwardly from first trunnion 132 at approximately a thirty degree angle from a plane parallel to the plane of stop surfaces **42*a* and 42*b* of lid 24 as seen in FIGS. 2–4**.

Figure 3:
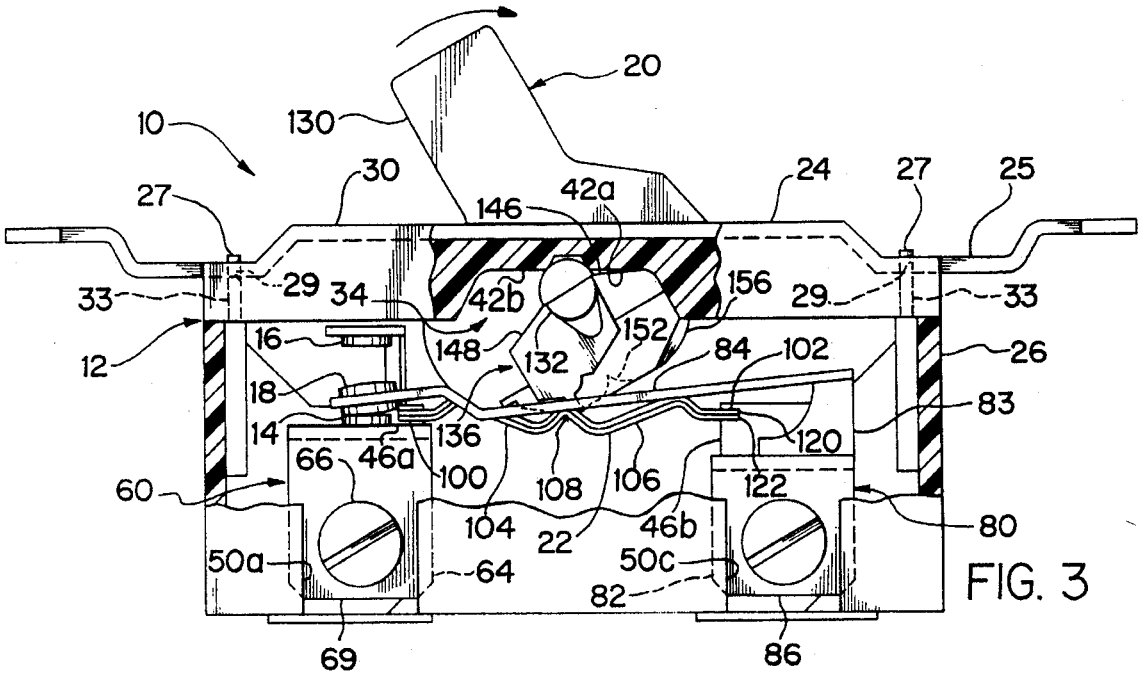
FIG. 3 is a side elevational view of the receptacle switch assembly of FIG. 2 with the toggle moved to its in maintained-on position, and with a portion broken-away to illustrate the relative positions of its contacts, spring and toggle in accordance with the present invention.
Figure 4:
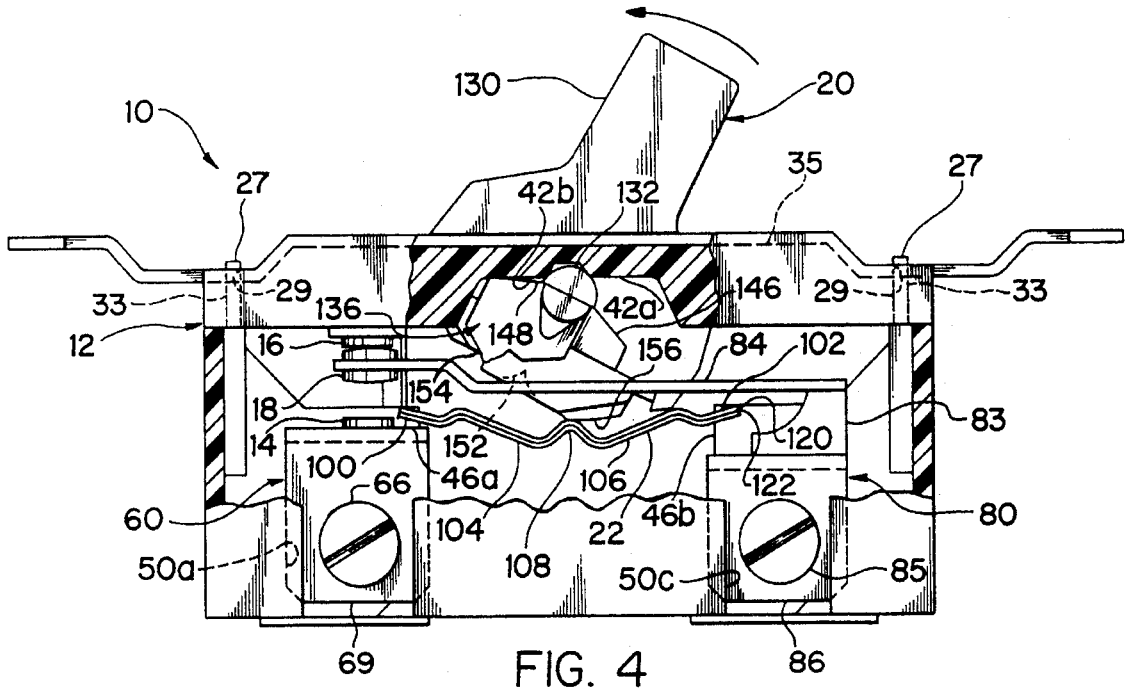
FIG. 4 is a side elevational view of the receptacle switch assembly of FIGS. 2 and 3 with the toggle moved to its momentary-on position, and with a portion broken-away to illustrate the relative positions of its contacts, spring and toggle in accordance with the present invention.
Figure 5:
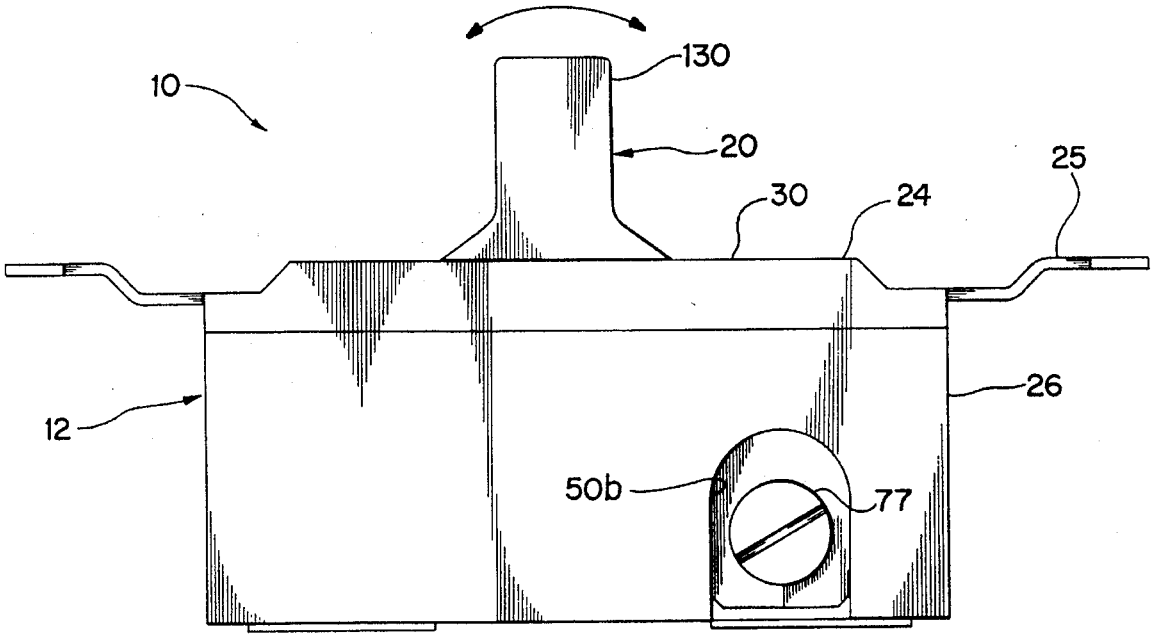
FIG. 5 is a back side elevational view of the housing of the receptacle switch assembly of FIGS. 1–4.
Figure 6:
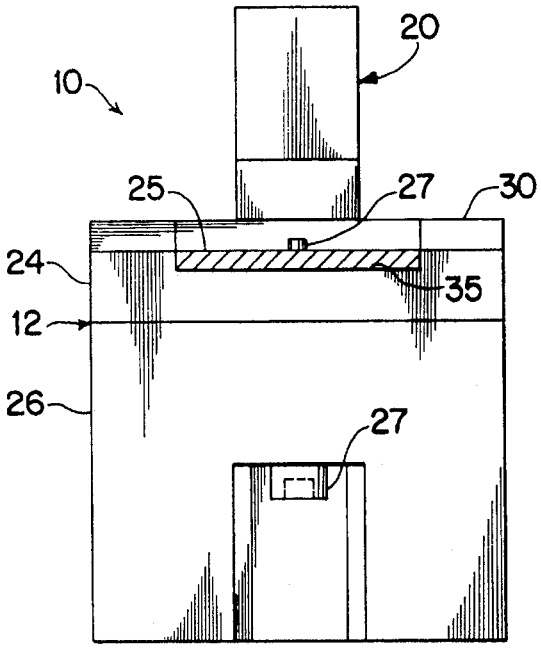
FIG. 6 is a left end elevational view of the housing of the receptacle switch assembly of FIGS. 1–5 with a portion of the mounting strap removed for clarity.

Specifically, when toggle 20 is pivoted to the maintained-on position as seen in FIG. 3, stop surface 146 engages stop surface **42*a* of lid 24 to limit pivotal movement of toggle 20 to the left. Stop surface 146 engages stop surface 42*a* substantially simultaneously as nose 108 engages second notch 154 and immediately after third contact 18 electrically contacts first contact 14. When toggle 20 is pivoted to the momentary-on position as seen in FIG. 4, stop surface 148 engages stop surface 42*b* of lid 24 to limit pivotal movement of toggle 20 to the right. Stop surface 148 engages stop surface 42*b* immediately after cam member 136 disengages cantilever arm 84 and after third contact electrically contacts second contact 16. The primary function of surfaces 42*a* and 42*b* is to prevent over travel of toggle 20**.

Bottom portion 140 has a bottom surface 150 for engaging leaf spring 22 to maintain toggle 20 in either the center-off position or the maintained-on position, and to bias toggle 22 to the center-off position when in the momentary-on position. Bottom surface 150 includes a first notch 152 located in the center of bottom surface 150, a second notch 154 located on one side of first notch 152, and a smooth, curved camming portion 156 located on the other side of first notch 152.

First notch 152 is a substantially V-shaped notch which extends upwardly from bottom surface 150 for receiving nose portion 108 of leaf spring 22 when in the center-off position as seen in FIG. 2. In the center-off position, the force of leaf spring 22 is directed upwardly into notch 152 and through the pivot axis of toggle 20. Thus, leaf spring 22 engages first notch 152 to prevent rotational or pivotally movement of toggle 20, until toggle 20 is pivoted with a force sufficient to bias leaf spring 22 downwardly out of first notch 152.

Second notch 154 is a shallower notch than first notch 152, and is spaced from first notch 152 by a relatively smooth transition surface 158. Second notch 154 receives nose portion 108 of leaf spring 22 when in the maintained-on position as seen in FIG. 3. In the maintained-on position, the force of leaf spring 22 is directed upwardly into notch 154 and through the pivot axis of toggle 20. Thus, nose portion 108 of leaf spring 22 engages second notch 154 to prevent rotational or pivotal movement of toggle 20, until toggle 20 is pivoted with a force sufficient to bias leaf spring 22 downwardly out of second notch 154.

Camming portion 156 extends from first notch 152 for engaging nose 108 of leaf spring 22 when toggle 20 is pivoted to the momentary-on position. The curvature of camming portion 156 is such that the distance between the pivot axis of toggle 20 and surface of camming portion 156 increases as leaf spring 22 slides further along the surface of camming portion 156 away from first notch 152. Thus, when toggle 20 is pivoted from the off position to the momentary-on position, leaf spring 22 is continually biased downwardly by camming portion 156. Thus, the upward force applied by leaf spring 22 against camming portion 156 increases as toggle 20 is pivoted to the momentary-on position. Since curved portion 156 is free of notches, the force of leaf spring 22 will pivot toggle 20 back to the center-off position upon releasing toggle 20.

OPERATION

As seen in FIG. 2, receptacle switch 10 is in its center-off position with toggle 20 extending perpendicularly from housing 12. In the center-off position, nose portion 108 of leaf spring 22 engages first notch 152 of toggle 20 to maintain toggle 20 in the center-off position. Also in the center-off position, cam member 136 of toggle 20 engages and holds third contact 18 apart from first contact 14 and second contact 16. Thus, in the center-off position, contacts 14, 16 and 18 are all spaced apart with third contact 18 being positioned between first contact 14 and second contact 16 to prevent electrical contact therebetween.

As seen in FIG. 3, the receptacle switch 10 is in the maintained-on position. When toggle 20 is rotated to the left from the center-off position, second notch 154 engages nose portion 108 of leaf spring 22 to hold toggle 20 in the maintained-on position and cam member 136 engages cantilever arm 84 to force third contact 18 downwardly into engagement with first contact 14.

As seen in FIG. 4, receptacle switch 10 is in the momentary-on position. In particular, toggle 20 is rotated to the right from the center-off position in the opposite direction of the maintained-on position. Rotation of toggle 20 to the momentary-on position causes cam member 136 to disengage cantilever arm 84 of third contact 18 which causes third contact 18 to automatically engage second contact 16 due to the resiliency of cantilever arm 84. Rotation of toggle 20 to the momentary-on position also causes nose portion 108 of leaf spring 22 to engage camming portion 156 of toggle 20. Since no notch exists on camming portion 156, nose portion 108 can not stop toggle 20 from immediately snapping back to the center-off position upon releasing trigger 130.

If toggle 20 is removed from housing 12 and replaced after being rotated 180°, then the maintained-on and the momentary-on positions would be reversed. In particular, second cam member 138 would now engage cantilever arm 84 to hold third contact 18 in its center-off position as shown in FIG. 2. However, since the placement of second notch 90 is now on the opposite side of trigger 130, the momentary-on position is now obtained when trigger 130 is rotated to the left as seen in FIG. 3 which causes second cam member 138 to engage cantilever arm 84 so that first and third contacts 14 and 18 will electrically contact each other as long as trigger 130 is held to the left. Similarly, the maintained-on position is obtained by rotating trigger 130 to the right which causes second cam member 138 to disengage cantilever arm 84 so that second and third contacts 16 and 18 will electrically contact each other.

While the most advantageous embodiment has been chosen to illustrate the invention, it will be understood by those skilled in the art that various changes and modifications can be made therein without departing from the scope of the invention as defined in the appended claims.

What is claimed is:

1. A receptacle switch assembly, comprising:

a housing;

first and second contacts coupled to said housing and spaced apart;

a third contact movably coupled to said housing for selectively engaging said first and second contacts;

activator means, movably coupled to said housing, for controlling movement of said third contact between an off position spaced from said first and second contacts, a maintained-on position electrically coupled with said first contact, and a momentary-on position with said third contact electrically coupled with said second contact; and control means, coupled to said housing, for selectively maintaining said activator means in said off position and said maintained-on position, and for biasing said activator means from said momentary-on position to said off position, said control means including a biasing means with a nose portion for engaging said activator means, said activator means including a trigger portion extending outwardly from said housing, a first notch for engaging said nose portion of said biasing means in said off position, a second notch positioned on one side of said first notch for engaging said nose portion of said biasing means in said maintained-on position, and a camming portion on the other side of said first notch for engaging said nose portion of said biasing means in said momentary-on position.

2. A receptacle switch assembly according to claim 1, wherein said housing includes a lid and a body releasably coupled to said lid.

3. A receptacle switch assembly according to claim 1, wherein said third contact includes first and second oppositely facing surfaces, said first surface for engaging said first contact when in said maintained-on position, said second surface for engaging said second contact when in said momentary-on position.

4. A receptacle switch assembly according to claim 1, wherein said first and second contacts are fixedly coupled to said housing.

5. A receptacle switch assembly according to claim 4, wherein said third contact is coupled to said housing by a movable lever.

6. A receptacle switch assembly according to claim 5, wherein said lever is resiliently coupled to said housing for pivotal movement between said first and second contacts.

7. A receptacle switch assembly according to claim 6, wherein said lever is a resilient cantilever arm.

8. A receptacle switch assembly according to claim 6, wherein said trigger portion is part of a toggle movably coupled to said housing.

9. A receptacle switch assembly according to claim 8, wherein said toggle has a pair of trunnions for pivotally coupling said toggle to said housing.

10. A receptacle switch assembly according to claim 9, wherein said camming portion has a substantially smooth, curved surface.

11. A receptacle switch assembly according to claim 9, wherein said biasing means includes a leaf spring.

12. A receptacle switch assembly according to claim 11, wherein said leaf spring includes a first spring layer and a second spring layer nested on said first spring layer.

13. A receptacle switch assembly according to claim 9, wherein said biasing means is a spring.

14. A receptacle switch assembly according to claim 13, wherein said toggle further includes cam means for engaging and moving said lever with said third contact from a first position to a second position when said toggle is selectively moved from said off position to said maintained-on position.

15. A receptacle switch assembly according to claim 14, wherein said cam means is coupled to said toggle for disengaging said lever to permit said third contact to pivot from said off position to said momentary-on position when said toggle is moved from said off position to said momentary-on position.

16. A receptacle switch assembly, comprising:

a housing;

first and second contacts coupled to said housing and spaced apart;

a third contact movably coupled to said housing by a movable, cantilevered lever;

a toggle movably coupled to said housing for controlling movement of said third contact between an off position spaced from said first and second contacts, a maintained-on position electrically coupled with said first contact, and a momentary-on position with said third contact electrically coupled with said second contact; and biasing means, coupled to said housing and engaging said toggle for selectively maintaining said toggle in said off position and said maintained-on position, and for biasing said toggle from said momentary-on position to said off position, said biasing means including a nose portion for engaging said toggle, said third contact including a first contact surface facing in a first direction for engaging said first contact when in said maintained-on position, and a second contact surface facing in a direction opposite to said first direction for engaging said second contact when in said momentary-on position, said lever being resiliently coupled to said housing for movement between a first position, a second position and a third position when said toggle is selectively moved between said off position, said maintained-on position and said momentary-on position, said toggle including a first end with a trigger portion extending outwardly from said housing and a second end with a first notch for engaging said nose portion of said biasing means in said off position, a second notch positioned on one side of said first notch for engaging said nose portion of said biasing means in said maintained-on position, a camming portion on the other side of said first notch for engaging said nose portion of said biasing means in said momentary-on position, and cam means for engaging and moving said lever with said third contact thereon between said first position and said second position upon movement of said toggle between said off position and said maintained-on position and for disengaging said lever to permit said third contact to pivot between said first and said third position upon movement of said toggle between said off position and said momentary-on position.

* * * * *